United States Patent [19]

Steiger

[11] 4,041,844

[45] Aug. 16, 1977

[54] HYDROSTATIC PISTON MACHINE

[75] Inventor: Anton Steiger, Illnau, Switzerland

[73] Assignee: Sulzer Brothers Ltd., Winterthur, Switzerland

[21] Appl. No.: 584,943

[22] Filed: June 9, 1975

[30] Foreign Application Priority Data

June 12, 1974 Switzerland ..... 8019/74

[51] Int. Cl.[2] ..... F01B 13/06

[52] U.S. Cl. ..... 92/58; 74/571 M; 91/491; 92/72; 92/148

[58] Field of Search ..... 92/58, 72, 148, 12.1; 74/571 M; 91/498, 491

[56] References Cited

U.S. PATENT DOCUMENTS

| | | | |
|---|---|---|---|
| 2,103,313 | 12/1937 | Benedek | 91/498 |
| 3,063,380 | 11/1962 | Strickland | 92/58 |
| 3,277,834 | 10/1966 | Eickmann | 92/58 |
| 3,357,312 | 12/1967 | Rogov | 91/498 |
| 3,357,362 | 12/1967 | Orr | 92/58 |
| 3,600,957 | 8/1971 | Stoffel | 74/571 M |
| 3,724,334 | 4/1973 | Denker | 92/58 |
| 3,738,230 | 6/1973 | Censi | 92/13.3 |
| 3,785,250 | 1/1974 | Steiger | 92/72 |
| 3,857,345 | 12/1974 | Higgins | 74/571 M |
| 3,878,768 | 4/1975 | Kress | 92/33 |

FOREIGN PATENT DOCUMENTS

| | | | |
|---|---|---|---|
| 1,155,336 | 10/1963 | Germany | 91/498 |

*Primary Examiner*—Martin P. Schwadron
*Assistant Examiner*—Abraham Hershkovitz
*Attorney, Agent, or Firm*—Kenyon & Kenyon, Reilly, Carr & Chapin

[57] ABSTRACT

The guide means for reciprocating the pistons of the cylinder block are mounted on rings which have bearing surfaces eccentric to the surface on which the cylinder block rotates. These rings are also of a diameter greater than the diameter of the surface on which the cylinder block rotates by at least twice the eccentricity of the machine.

7 Claims, 3 Drawing Figures

HYDROSTATIC PISTON MACHINE

The invention relates to a hydrostatic piston machine.

Hydrostatic piston machines have been known to employ a cylindrical block with radial pistons which is rotatable about a control journal. These machines usually use a guide means to effect a stroke of the pistons with the guide means being rotatably mounted eccentrically of the cylinder block on trunnions at both sides of the control journal. Such a piston machine is known, for example from published German Patent Application No. 2,134,944.

In some cases, it has been proposed to install the guide means at both sides of the control journal, and namely on bearing surfaces of the same diameter at both sides. In this way, an entirely symmetrical loading of the bearing surfaces and deformation of the journal is obtained which is particularly important for a hydrostatic installation.

It is an object of this invention to permit a simpler assembly and disassembly of the movable parts of a hydrostatic piston machine while at the same time retaining a symmetrical construction and symmetrical deformation of the machine.

Briefly, the invention provides a hydrostatic piston machine having a control journal, a cylinder block mounted in rotatable relation on a cylindrical surface of predetermined diameter of the control journal, a plurality of pistons slidably mounted in the cylinder block in radial relation, a pair of trunnions on the control journal and guide means for reciprocating the pistons in the cylinder block. Each trunnion has an outer cylindrical bearing surface of a diameter greater than the diameter of the surface ofthe control journal while being equal to the other. The guide means are mounted on the bearing surfaces of the trunnions in rotatable relation to the control journal eccentrically of the cylinder block.

With such a machine it is possible, during assembly, to push the bore of the guide means over the trunnions. The guide means can also be disassembled in a similar way. It is therefore not necessary to disassemble the control journal and the trunnions in order to disassemble the guide means. At the same time, with this form of construction, the fabrication of channels in the journal for the hydraulic drive-medium is facilitated, because the journal is of relatively large cross-section.

The diameter of the trunnions is greater preferably by twice the eccentricity of the guide means to the cylinder block. In this way, a further simplification of the assembly and disassembly of the machine is obtained because the guide means can simply be moved in an axial direction over the trunnions.

The bearing surface of at least one of the trunnions may be formed on a ring having an eccentric bore and which is supported on the journal of the machine. At the same time, the bearing surface of the control journal may be formed on a ring having a concentric bore and which is also fastened to the journal. In this way, a further simplification of the machine is obtained because the individual bearing surfaces of the control journal and of the trunnions are made on separate parts, after which they are fastened to a simple cylindrical journal.

In one embodiment, the ring with an eccentric bore for installing the guide means and the ring with a concentric bore for installing the cylinder block may form a single unit. This construction is particularly suitable for a double machine with two adjacent cylinder blocks.

These and other objects and advantages of the invention will become more apparent from the following detailed description and appended claims taken in conjunction with the accompanying drawings in which:

Figure 1:
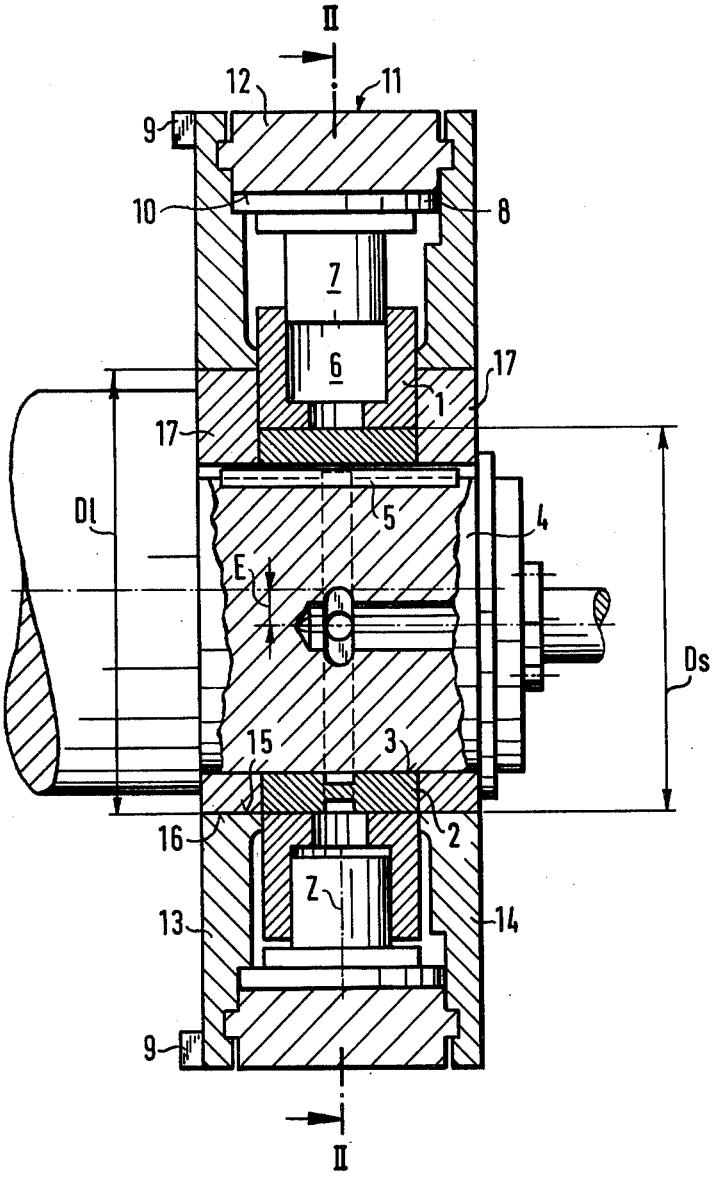
FIG. 1 illustrates an axial section through a hydrostatic piston machine constructed in accordance with the invention.

Referring to FIG. 1, the hydrostatic piston machine includes a cylindrical control journal 4 having a shouldered cylindrical end portion on which a cylinder block 1 is mounted in rotatable relation via a cylindrical ring 2. The ring 2 has a bore 3 which is concentric and coaxial of the end portion of the control journal as well as an outer bearing surface on which the cylinder block slides. The ring 2 is fixedly mounted on the journal 4 via a key 5 which fits into suitable grooves in the journal 4 and ring 2.

The cylinder block 1 contains radial cylinder bores 6 in which pistons 7 are guided in known fashion. Each piston 7 has a bearing surface 8 which is perpendicular to the axis Z of the respective bore 6 and which bears against a respective flat guide surface 10 of a guide means 11. This guide means 11 serves to reciprocate the pistons 7 in the cylinder block 2 and includes a guide ring 12 with two interconnected side walls 13, 14. The side walls 13, 14 are located on opposite sides of the cylinder block 1 and contain bores 15 by which the sidewalls are rotatably mounted on outer cylindrical bearing surfaces 16 of a pair of trunnions 17 on the control journal 4.

The trunnions 17 are formed by rings which are secured by one or more keys 5 to the control journal 4. As shown, the bearing surfaces 16 of the rings 17 are eccentric to the central bores of the rings 17 and thus to the axis of the control journal 4. The eccentricity E of the surfaces 16 is the same as the eccentricity of the machine.

One ring 17 abuts the shoulder of the control journal 4 while the other ring 17 is held in place by a suitable snap ring or the like which fits into a groove in the control journal 4. Thus, in order to disassemble the guide means 11, the side walls 13, 14 are moved off the rings 17 to each side of the machine and the guide ring 12 moved to one side or the other.

As shown in FIG. 1, the ring 2 supporting the cylinder block 1 is of a diameter $D_s$ while the bearing surfaces 16 of the rings 17 are each of the same diameter $D_1$ which is greater than the diameter $D_s$ of the ring 2 by at least twice the eccentricity E of the guide means 11 to the cylinder block 1.

In order to provide for a power take-off, one of the side walls 13 is provided with protrusions 9 as is known. Further, in order to supply and remove a hydraulic medium, the journal 4 is provided with channels 18, 20 which communicate with the piston bores 6 via control ducts 21, 22 in the ring 2.

Figure 2:
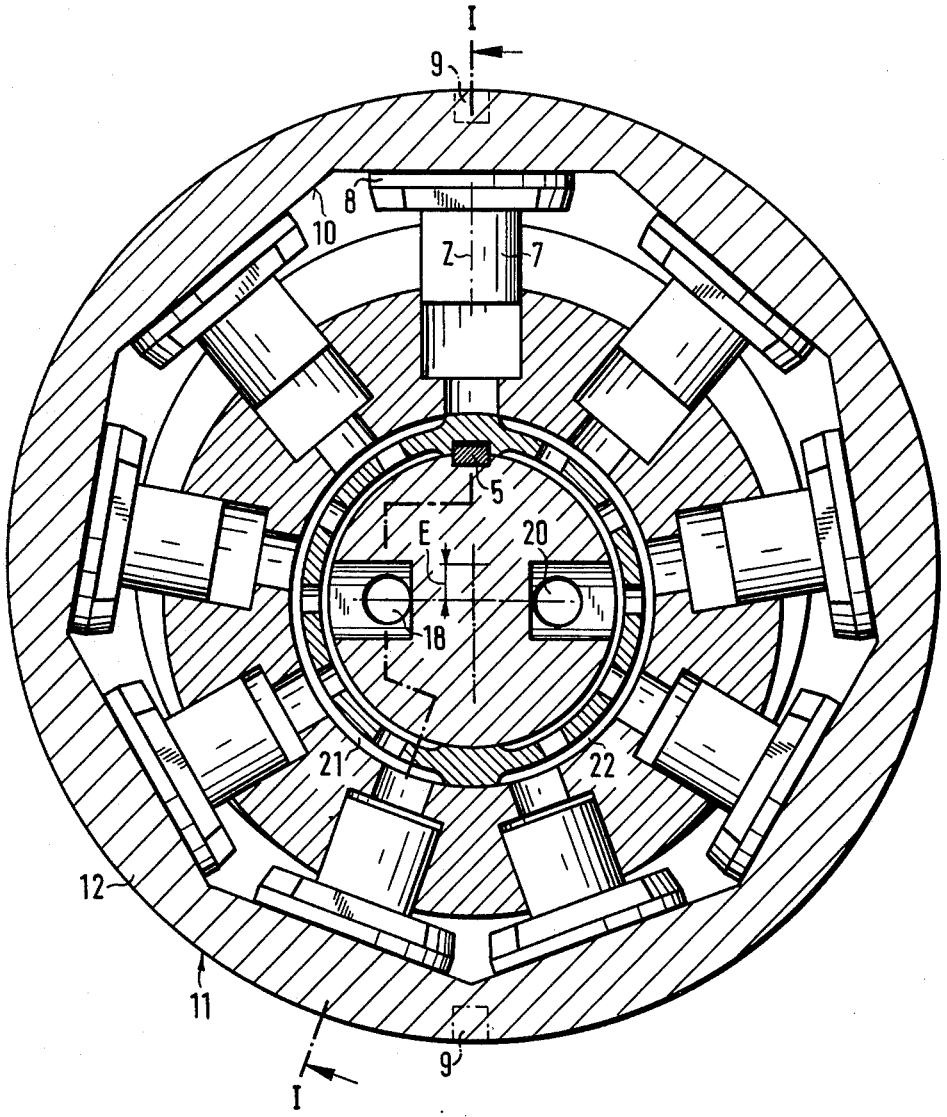
FIG. 2 illustrates a view taken on line II—II of FIG. 1.

As shown by FIGS. 1 and 2, because of the relationship of the diameters $D_1$ and $D_s$, the side wall 13 at the left side of the machine can be simply pushed over the ring 2 on the journal 4 during assembly or disassembly. The ring 2 thus forms a journal. In order to disassemble the cylinder block 1, only the righthand ring 17 need be pulled off the journal 4. Thus, the machine with the guide means 11 and side walls 13, 14 is quite symmetrical, so that during operation nonsymmetrical loads and nonsymmetrical deformations are avoided. This is particularly important in the case of a hydrostatic installation of the individual rotatable parts of the machine.

Figure 3:
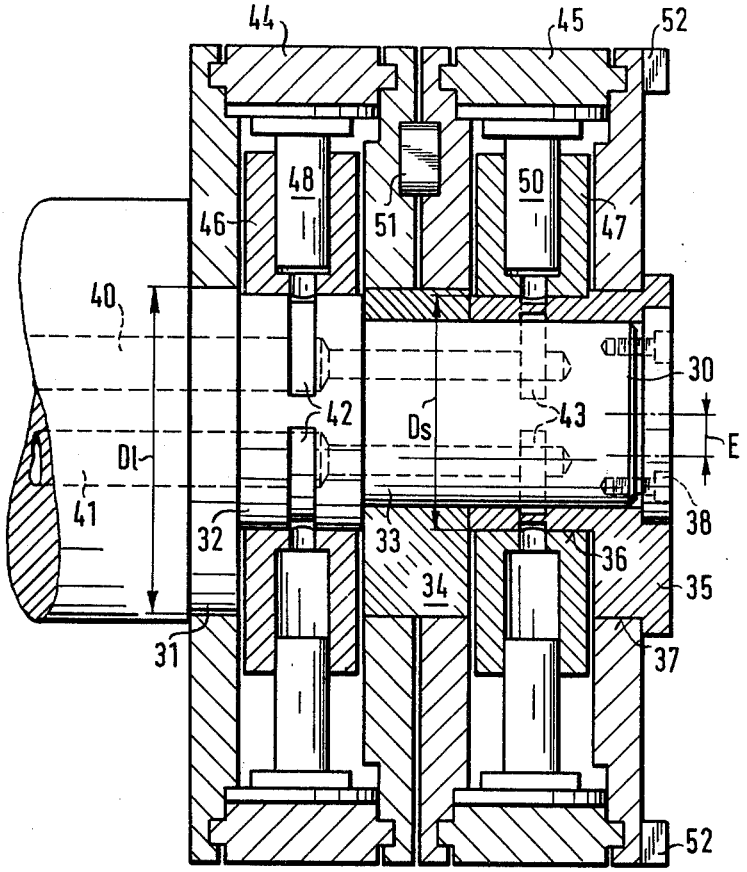
FIG. 3 illustrates a sectional view similar to that of FIG. 1 of a double machine having two cylinder blocks.

Referring to FIG. 3, a hydrostatic piston machine may have two adjacent cylinder blocks provided with guide means as above. In this case, the journal 30 has a stepped end portion which comprises an eccentric section 31, a concentric section 32, and a likewise concentric section 33 for mounting purposes. A ring 34 with an eccentric bore is secured to the concentric section 33. This ring 34 has an outer diameter which is equal to the outer diameter $D_1$ of the eccentric section 31. A part 35 is also fastened to the section 33 of the journal 30. This part 35 comprises a control section 36 coaxial with the bore of the part 35 as well as an eccentric section 37. The eccentric section 37 has the same outer diameter $D_1$ and the same eccentricity E as the ring 34 and the section 31 of the journal 30. The control sections 32 and 36 have equal diameters $D_s$. In this case also, $D_1$ is at least, the same size as $D_s + 2E$.

As shown, the part 35 is fastened to the end face of the journal 30 by screws 38.

The journal 30 is also provided with channels 40, 41 for the hydraulic medium which communicate with control ducts 42 in the control section 32, and with ducts 43 in the control section 36 of the part 35.

As is shown in FIG. 3, the machine comprises two guide means 44, 45 and two adjacent cylinder blocks 46, 47 with pistons 48, 50. The guide means 44, 45 are connected together by connecting keys 51 for transmitting the torque. For the power take-off, one guide means 43 is provided with protrusions 52 as above.

In order to disassemble the guide means, the screws 38 are removed and the common ring 35 is slid off the journal 30. Next, the side wall with the protrusions 52 is removed. Further disassembly requires removal of the cylinder blocks 47, 46 the remaining side walls of the guide means and the ring 34.

The invention thus provides a hydrostatic piston machine which can be easily assembled or disassembled. Further, the rings which support the cylinder block and at least one side wall of a guide means can be formed as a single unit, for example as shown in FIG. 3.

What is claimed is:

1. A hydrostatic piston machine comprising a control journal having a cylindrical surface thereon of predetermined diameter;

a cylinder block mounted in rotatable relation on said surface of said control journal;

a plurality of pistons slidably mounted in said cylinder block radially thereof;

a pair of trunnions on said control journal, each said trunnion having an outer cylindrical bearing surface thereon of a diameter greater than said predetermined diameter and equal to each other; and guide means for reciprocating said pistons in said cylinder block, said guide means being rotatably mounted on said bearing surfaces of said trunnions in rotatable relation to said control journal eccentrically of said cylinder block.

2. A hydrostatic piston machine as set forth in claim 1 wherein said bearing surfaces of said trunnions are of a diameter greater than said predetermined diameter by at least twice the eccentricity of said guide means to said cylinder block.

3. A hydrostatic piston machine as set forth in claim 1 wherein at least one of said trunnions is a ring having an eccentric bore mounted on said control journal.

4. A hydrostatic piston machine as set forth in claim 3 which further comprises a ring fixedly mounted on said control journal with said surface of predetermined diameter formed thereon.

5. A hydrostatic piston machine as set forth in claim 4 wherein said rings are formed into a single unit.

6. A hydrostatic piston machine as set forth in claim 4 wherein said trunnions are fixedly mounted on said control journal with said ring.

7. A hydrostatic piston machine as set forth in claim 1 wherein said trunnions are fixedly mounted on said control journal.

* * * * *